United States Patent [19]

Wojtowicz et al.

[11] 4,273,300

[45] Jun. 16, 1981

[54] FLEXIBLE ELEMENT ROLLING AND HANDLING APPARATUS

[76] Inventors: Walter Wojtowicz, R.R. 4, Box 216; Gust Mursau, Rte. 1, Box 390, both of Crivitz, Wis. 54114

[21] Appl. No.: 61,749

[22] Filed: Jul. 30, 1979

[51] Int. Cl.[3] ..... B65H 19/20

[52] U.S. Cl. ..... 242/56 R

[58] Field of Search ..... 242/56 R, 67.1 R, 67.2, 242/67.3 R, 67.4

[56] References Cited

U.S. PATENT DOCUMENTS

| | | | |
|---|---|---|---|
| 2,830,775 | 4/1956 | Kiesel | 242/56 R |
| 3,386,678 | 6/1968 | Malone | 242/56 R |
| 3,931,940 | 1/1976 | Raighs | 242/56 R |
| 4,160,528 | 7/1979 | Malone | 242/56 R |

*Primary Examiner*—Edward J. McCarthy

*Attorney, Agent, or Firm*—Andrus, Sceales, Starke & Sawall

[57] ABSTRACT

A carpet, linoleum or other material stored in a storage roll form is rotatably supported in a handling unit for selective and successive removal of selected lengths thereof. The unit includes a main or storage unroll support means which is mounted in parallel spaced relation to a reroll support means. The support means are coupled to independently controlled drive means to permit the selective transfer of the element between a storage roll on the unroll support means and a roll of the element on the reroll means. The apparatus permits controlled and automated unrolling and rerolling of selective lengths of the element. The unit thus includes an unroll cradle and a reroll cradle, each of which includes a pair of parallel and spaced rollers and a plurality of supporting endless belt members. The reroll cradle has the outer roller pivotally mounted to permit forming a belt loop therebetween for initial carpet rerolling and thereafter to enlarge to support the rerolled carpet. A drive roller and opposed pressure roller is mounted intermediate the cradles to firmly grip the carpet flap and move the carpet into the reroll cradle. A constant-torque D.C. motor drive means is coupled to selectively reversely rotate the rollers of the respective cradles and the intermediate roller. An automatic knife is provided between the cradles for severing of the portion of the carpet. The unroll cradle is mounted for limited angular orientation for accurate squaring of the carpet relative to cutter. A metering wheel is driven by the carpet and when a preset amount has been unwound, the machine automatically and rapidly stops.

18 Claims, 8 Drawing Figures

FLEXIBLE ELEMENT ROLLING AND HANDLING APPARATUS

BACKGROUND OF THE INVENTION

This invention relates to a flexible element rolling and handling apparatus and particularly to such apparatus for the selective unrolling and rerolling a carpet or like element without the necessity of manually handling the roll.

Various sheet-like members may be conveniently stored, transported and the like in a coiled or rolled form. For example, carpets and other floor covering elements as well as many other flexible sheet-like elements are often rolled upon themselves for convenient handling, transport, and storage and the like. As the elements are to be used, an appropriate length is unwound and severed from the storage roll. For example, carpeting and the like is conventionally wound upon a tubular core and stored as large roll in a retail establishment for subsequent sale of appropriate lengths to the home owners and other similar retail purchasers. Carpets are generally formed in a relatively standard width of 12 to 15 feet, and such rollers are relatively large, heavy and bulky. They can be, however, and are conveniently moved, using a conventional fork lift unit having an appropriate supporting rod member which can be inserted into the central core area. When a customer desires a particular length, the storage roll is removed from storage, preferably using an appropriate fork lift or the like to permit handling of the large bulky and heavy rolls, and the appropriate amount of the roll unwound. The unwound flap is cut to the desired length, rolled and tied into a final reroll for delivery to the customer. The flap portion is rewound on the storage roll which is again returned to storage. Generally the unwinding, cutting and rewinding and the like is done manually. Although a widely used method, it is time consuming, requires a plurality of personnel to handle the large storage rolls and is generally relatively costly because of the bulkiness and the weight of the carpet rolls and the like. The usual system also, of course, relies on the care and ability of the workmen to appropriately measure and severe carpeting into the appropriate sizes, as well as providing an appropriately finished end for delivery of the severed portion of the carpeting to the customer. Even with careful personnel, errors do occur; and if careless, relatively large losses may result.

Carpet coiling or rolling apparatus has generally been suggested in various environments, and particularly for the rolling of a flat carpet element such as received from a washing means as well as the originally forming and the like. For example, U.S. Pat. Nos. 2,174,411, 3,501,106 and 3,850,381 discloses rolling devices which refer to carpeting and the like and include means of rolling a length of the carpeting into a roll. The present inventors know of no system which has provided for the automated rolling and rerolling of storage rolls of carpets or the like, particularly for use in a retail environment. There is therefore, a distinct need for a roll handling apparatus which can be practically and economically used in a retail environment.

Thus, the reroll apparatus must be available at a reasonable cost and operable with minimum skill and preferably operable by one operator. The apparatus must of course not damage the carpet or other material.

SUMMARY OF THE PRESENT INVENTION

The present invention is particularly directed to an automated roll handling apparatus particularly adapted for the selective unrolling and rerolling of an indefinite length of a flexible element such as a carpet, linoleum or other material stored in a storage roll form and adapted to selective and successive removal of lengths of the element from the storage roll. Generally, in accordance with the teaching of the present invention, the roll handling apparatus includes a main or storage unroll support means which is mounted in parallel spaced relation to a reroll support means. The support means are coupled to independently controlled drive means to permit the selective transfer of the element between a storage roll on the unroll support means and a roll and a roll of the element on the reroll means. The apparatus permits controlled and automated unrolling and rerolling of selective lengths of the elements.

More particularly in an optimum embodiment of the present invention, the unroll support means and the reroll support means are cradle units, each of which preferably includes a pair of parallel and spaced rollers with a plurality of supporting endless belt members longitudinally spaced along the length of the rollers. A drive means is coupled to rotate at least one of the roller means of the respective cradle units and thereby the belt members during the unrolling and reroll of the carpet. The rollers of the reroll cradle unit are mounted for relative parallel movement to selectively vary the size of the opening therebetween. The flexible belt members are adapted to extend downwardly between the rollers and support the rerolled carpet roll.

The independent and separate drive of the units is particularly desirable to establish versatile and reliable system operation. The drive preferably includes a constant torque D.C. motor, coupled to the cradle units by separate clutch means, to permit the continuous driving of the units. The reroll cradle unit 5 is driven at a slightly faster speed. Then the infeed of the unroll unit 2 and driven roller 8 with slight slippage in the reroll unit readily accommodating such differential drive speeds. The drive system thereby maintains the carpeting in a taut condition between the two units for accurate transfer, metering and cutting without damage thereof. An automatic cutting mechanism is provided between the unroll cradle unit and the reroll cradle unit to permit severing of the portion of the carpet fed into the reroll cradle unit. At least one of the cradle units is mounted for limited angular orientation relative to the opposite cradle unit to permit accurate squaring of the carpet therebetween and relative to the cutting mechanism.

In a practical embodiment, a drive roller and opposed pressure roller is mounted intermediate the cradle units to firmly grip the carpet flap and move the carpet into the reroll cradle unit. The pressure roller is released during the initial squaring of the cradle units and then closed. A metering means is also mounted to be driven by the carpet as it moves over the drive roller into the reroll unit. When the preset amount has been unwound from the storage roll, the machine automatically and rapidly stops to accurately locate the trailing end of the selected portion over the cutting mechanism. The cutter mechanism is then actuated to severe the carpeting along such line.

The unroll cradle unit preferably includes the pair of spaced rollers and a plurality of endless belts defining a support for the carpet roll. The spaced rollers are mounted in a frame which pivots on a vertical center for angular orientation of the cradle unit relative to the cutting bar for squaring of the carpeting in relation to the cutting bar. The reroll cradle unit consists of a stationary powered roller which is located adjacent to the discharge side of the cutting bar and nonpowered movable roller is mounted adjacent the forward face or portion of the stationary roller. A lower idler roller is located generally below and between the fixed and movable roller to support the belting as the movable roller is positioned between the closed and an open position. Thus with the rollers closed the flexible belting moves downwardly and beneath the fixed and movable rollers. In the opened position, the pivoted roller pivots outwardly and the belting moves correspondingly outwardly, permitting the location and support of a relatively large roll of carpeting therebetween. The initial rolling of the carpet is affected with the rollers in a closed position to define a small inner loop such that the carpet flap is caused to reroll upon itself within such loop. After the initiation of the reroll, the rollers of the reroll cradle unit are opened, at least partially, to permit the enlargement resulting from continued rerolling of the carpeting. When the desired length has been removed and severed, the reroll cradle unit is driven to roll the severed portion upon the reroll. The reroll cradle unit rollers are then moved to the closed position to automatically force the reroll from between the cradle rollers and causing it to roll onto the adjacent supporting surface. The unroll cradle unit may be actuated in a reverse direction to rewrap the loose end or flap of the carpet to form a compact roll which can then be returned to storage.

The present invention thus provides a roll handling system particularly adapted for handling of flexible floor covering rolls and the like for relatively rapid and reliable removal of the material. The apparatus requires limited amount of floor space, can be made readily portable and may be under a complete control and operation by a single person. The present invention thus provides a roll handling apparatus which is particularly adapted for use in a conventional carpet retail store or the like.

DESCRIPTION OF THE ILLUSTRATED DRAWINGS

The drawings furnished herewith illustrates a preferred construction of the present invention in which the above advantages and features are clearly disclosed as well as others which will be readily understood from the following description.

Figures 1, 2, 3B, 3C:
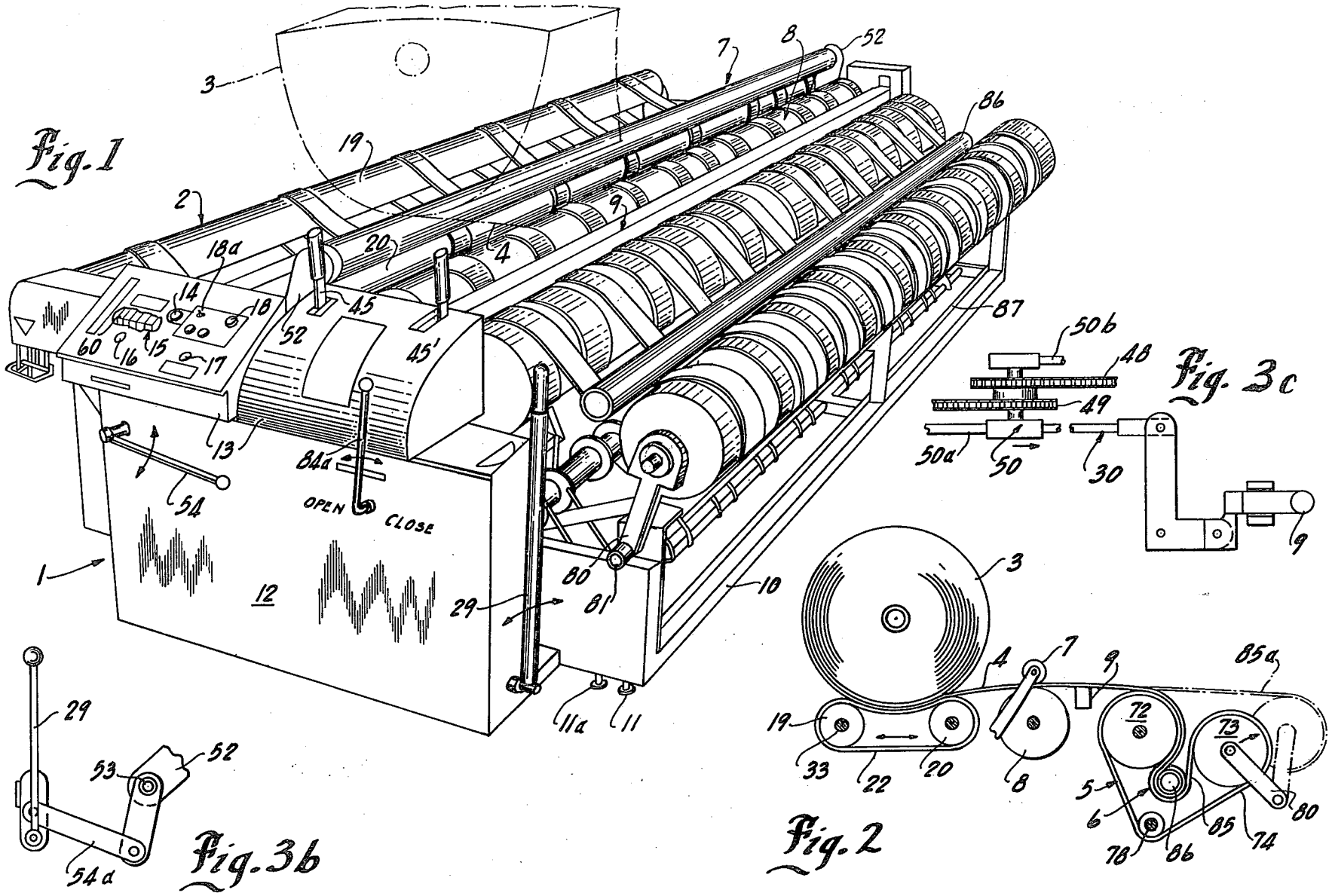
FIG. 1 is a pictorial view of a carpet roll handling apparatus constructed in accordance with the teaching of the present invention.
FIG. 2 is a simplified illustration of the apparatus more clearly illustrating the movement of the carpet through the winding apparatus.
Figures 3, 3A, 5:
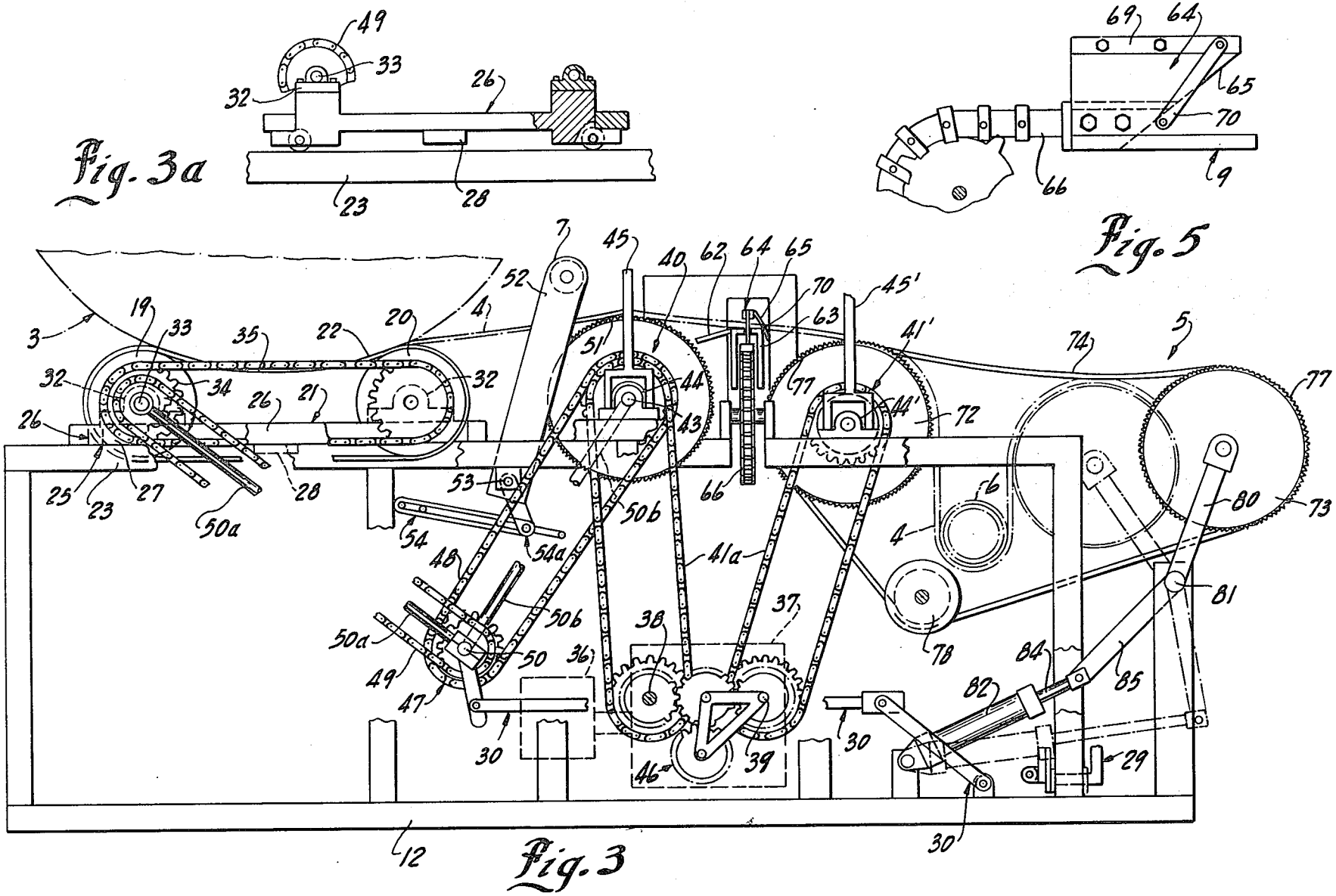
FIG. 3 is an enlarged side elevational view with parts broken away and sectioned to illustrate the roller drive and control arrangement mechanism.
Figure 4:
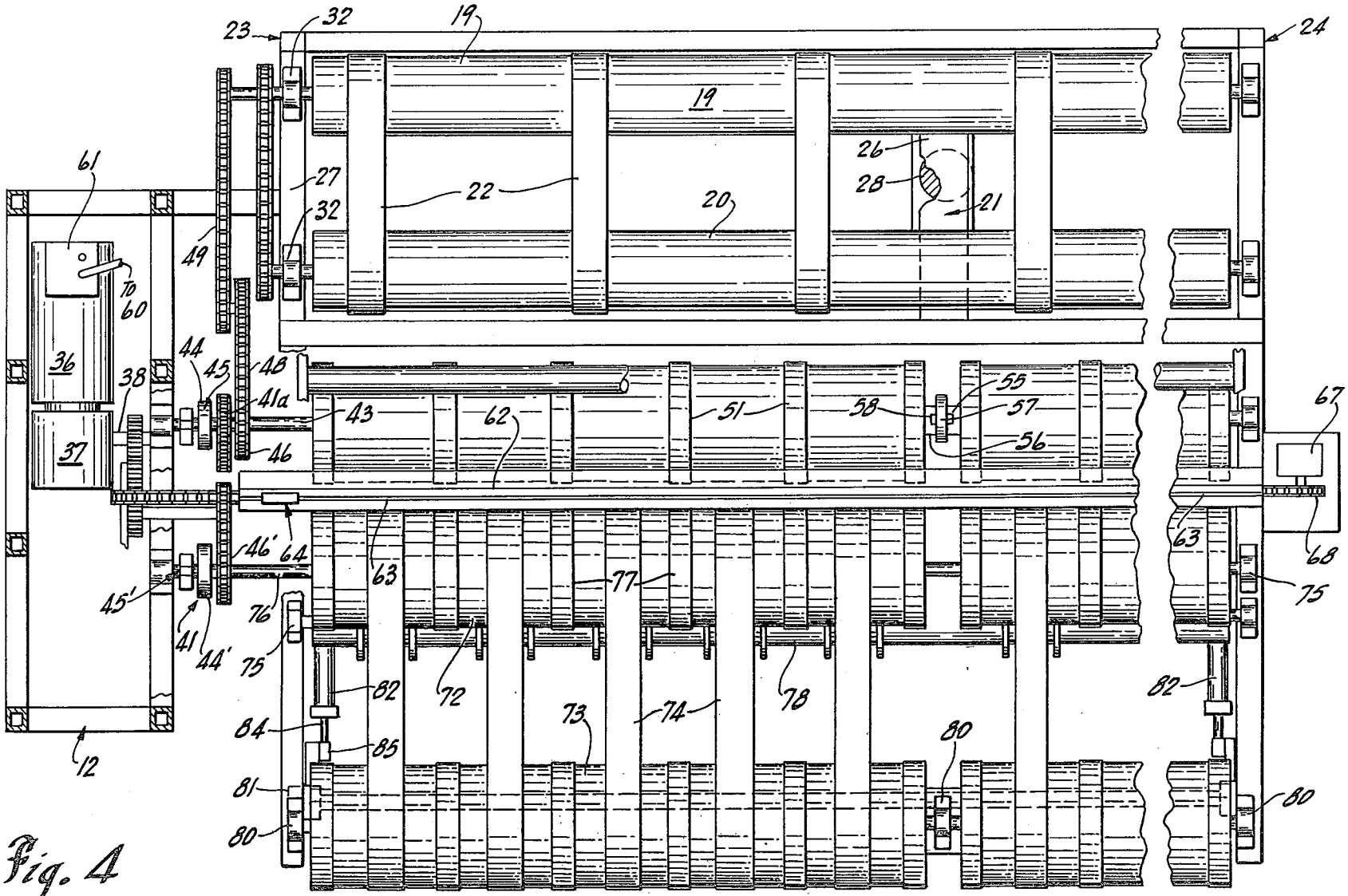

FIG. 3*a* is a fragmentary view of an orienting support for a carpet roll;

FIG. 3*b* is a fragmentary top view of the orienting linkage shown in FIG. 3;

FIG. 3*c* is an enlarged, separate illustration of a pressure roller positioning linkage;

FIG. 4 is a top view of the apparatus shown in FIGS. 1–3; and

FIG. 5 is an enlarged fragmentary view taken generally on line 5—5 of FIG. 4 to show detail of a carpet severing apparatus as shown in FIGS. 1, 3, and 4.

DESCRIPTION OF THE ILLUSTRATED EMBODIMENT

Referring to the drawings and particularly to FIGS. 1 and 2, a carpet reroll machine 1, forming an embodiment of the invention, is shown including a front unroll cradle assembly or unit 2 adapted to support a large storage carpet roll 3 which includes a length of carpeting substantially greater than that normally dispensed. The roll 3 is normally of a standard 12 or 15 foot width and the cradle unit 2 is preferably of a sufficient width to handle such standard rolls. The roll 3 has an outer flap 4 and a desired length of the carpeting is unrolled and removed for distribution as required. A rear cradle unit 5 is mounted in spaced, parallel relation to the front cradle unit 2 and is adapted to receive the free end or flap 4 from the main storage roll 3 and reroll the carpeting into a final retail roll 6 as it is removed from the main storage roll 3. A pressure roller 7 is located between the unroll cradle unit 2 and reroll cradle unit 5 and operates in conjunction with an auxiliary drive roller 8 to selectively lock onto the carpet flap 4 and withdraw the carpet from the roll 3 and deliver it to reroll cradle unit 5.

A cutting or severing unit 9 is located between the drive roller 8 and reroll cradle unit 5 and is powered driven for selective cutting of the carpeting flap 4 aligned thereon. The unroll cradle unit 2 and the driver roller 8 are coupled to be simultaneously driven to remove the carpet from roll 2. The reroll cradle unit 5 is independently and separately driven to reroll the carpet within the cradle unit 5 at an appropriate speed to tightly coil the carpeting on itself as at 6.

The independent drive of the unroll and reroll cradle units 2 and 5 permit for the main movement of carpeting from the main storage roll 3, over the cutting or severing unit 9 into the reroll cradle unit 5 where it is formed into roll 6, after which the severing unit 9 is actuated to separate the rolls. Thereafter, the reroll cradle unit 5 is driven to complete rolling or winding of the portion from the cutting unit on to the roll 6. The unroll cradle unit 2 is reverse driven to receive the flap from the cutting unit onto the main roll.

More particularly, the roll handling apparatus includes a supporting framework 10 which is provided with appropriate dolly-type wheels 11 to permit movement of the apparatus within a room or building as required. Suitable leveling feet members 11*a* are provided for selective leveling of the mechanism and supporting of the apparatus during the reroll of carpet 2. The spaced cradle units 2 and 5 and associated components are appropriately mounted on the framework 10 and particularly to opposite end wall frame structures. The cradle drive mechanism and coupling is generally provided adjacent the front end wall structure of the apparatus, as presently described.

The apparatus includes a drive assembly housed within a suitable enclosure 12 secured to the one end of the framework 10 and coupled as hereinafter described to drive the cradle units 2 and 5 and the drive roller 8. A control housing 13 is located to the top of the housing 12 and is provided with the various main on-off and speed control inputs. Thus, the control preferably includes a manual-automatic selection switch means 14, shown as a rotary selector which provides for transfer of carpet of a preset length or of an indefinite length.

A presettable counting unit 15 is provided which can be set to selected length to be removed from storage roll 3. A reset button 16 allows zeroing of the counting unit of the start of the feeding of the carpeting for rerolling. The counting unit 15 is then driven, as subsequently described, to transfer such length. The final edge of the carpet 4 to be removed is automatically aligned with the cutting unit 9. A knife switch control 17 shown as a push-button switch, allows the operator to actuate knife to sever the removed length of the carpet. The separate control is desirable to allow final change or adjustment in the carpet length prior to cutting. The various types of carpeting or other floor coverings which might be handled may require or permit different transfer speeds. A drive speed control 18 is provided, shown as a simple rotary speed selector. The control 18 may, for example, be a suitable potentiometer control for the motor drive subsequently described. This permits the controlled starting of the movement of the carpet to prevent possible damage which might occur if full drive force is applied directly to the carpet. Further, the operator may desire to reverse the movement of the carpeting during final adjustment after cutting of the carpeting as well as other processing and handling. The apparatus thus preferably includes a reversing drive means, as hereinafter described, which is provided with a direction selection means shown as a part of a main on-off toggle switch unit 18*a* which when centered is off and is movable to the opposite sides thereof to establish corresponding direction and movement of the carpet. Such controls may be of any construction and incorporated into any suitable control system for controlling of the several drive means hereinafter described and such detail is not therefore further shown or described herein because it is readily understood and available, particularly from those providing control means.

In the illustrated embodiment of the invention, the unroll cradle unit 2 includes two laterally spaced rollers 19 and 20 which are rotatably mounted at the opposite ends in a supporting cradle frame 21. A plurality of longitudinally spaced endless belts 22 encircle the rollers 19 and 20 and form a concave support for a carpet roll 3. The belts 22 may be of any suitable belting material having a sufficient strength to support the carpet roll 2 and provide rotation of the carpet roll 2. The roller 20 is mounted in the preferred embodiment pivoting movement to permit accurate squaring of the carpet roll 3 and particularly flap 4 in relation to the cutting unit 9 and the reroll unit 5, as presently developed. The separate frame 21 is preferably slidably supported at the opposite ends thereof on the front and rear end walls 23 and 24 of the main frame 10 as at 25. The separate frame 21 includes vertical end members 27 interconnected to a base 26 which is slidably mounted at the opposite ends and further is provided with a center pivot support or mount 28 secured to main frame 10 and base 26 permitting the limited angular orientation of the cradle unit 2 in a horizontal plane about a central vertical axis. A control lever 29 is provided adjacent to the one end of the apparatus 1 immediately adjacent to the reroll cradle unit 5. The lever 29 is pivotal around a horizontal axis and connected by a linkage 30 to pivot the reroll cradle frame 21 about the pivot mount 28 for physically positioning of the cradle frame and therefore the parallel rollers and about its pivot mount. This permits squaring of the carpet roll 2 and thereby carpet 4 with respect to the severing unit 9 and the reroll cradle unit 5. Frame 21 may be roller mounted such as shown in FIG. 3*a*, with suitable crown type rollers 30*a* or the like.

The rollers 19 and 20 may be a suitable steel tubing and of a length slightly greater than the maximum length of a carpet roll 3 to be handled. The rollers 19 and 20 are rotatably mounted at the opposite ends in suitable bearings 32 in the vertical end members 27 of the pivotally mounting cradle frame 21. The rollers 19 and 20 adjacent to the front end member 27 and wall 23 have drive shafts 33 which project outwardly with suitable gears 34 affixed thereto. A drive chain 35 couples the gears to each other. The roller shaft 33 of the outer roller 19 is also connected to a drive motor 36 for corresponding rotational movement, as presently described.

Thus the rollers, as viewed in the diagrammatic view of FIG. 2, are rotated in a clockwise direction causing the support belts 22 to correspondingly move in a clockwise direction for rotating the storage carpet roll 3 in a counterclockwise direction and feeding the bottom layer and flap 4 into the pressurized drive roller 8.

The drive motor 36 is preferably a direct current (D.C.) constant torque motor of a permanent magnet type to provide high starting torque for controlled starting and stopping of the carpet movement. The constant torque motor also permits stalling of the drive system without overloading of the motor 36. The output of the motor 36 is coupled through a suitable reversing and speed reducing gear box 37 to first and second output shafts 38 and 39 and establishes a first output drive for the unroll cradle unit 2 and the intermediate drive roller 8 and a second output drive for the reroll cradle unit 5.

The two output drives include separate clutch units 40 and 41 coupled to output shafts 38 and 39 from the gear box 37 through similar coupling chain drives 41*a*. Each clutch unit 40 and 41 is similarly constructed and reference is made to the unroll clutch 40 for reference, with corresponding elements of clutch 41 identified by corresponding primed numbers. Thus, referring to clutch 40, a clutch plate assembly 42 is mounted with a sliding coupling on the driven shaft 43 of the roller 8. A lever and collar member 44 includes a pivotally mounted lever 45 for sliding placement of the clutch plate assembly 42 into engagement with a drive clutch plate 46 which may form a part of the sprocket and which is secured to the roller shaft 43 and forms the coupling part of the chain drive to appropriately drive roller units of unit 2. For example, a suitable on-off type clutch unit is available from the Morris Chain Division of Borg Warner, as a Rockford overcenter clutch model LMS5522. Thus, the clutch selectively couples the shaft 38 to shaft 43. Shafts 38 and 39 are driven in a forward or reverse drive direction from reversible motor 36 in any suitable manner. In the illustrated embodiment, gear box 37 further includes a reverse gear coupling unit 46, which can be positioned from the control panel to permit reversal of the relative rotation of unit 5, particularly the belts and drive roller to reverse the direction of carpet reroll within the unit 5. This would expose the nap portion, while the illustrated direction exposes the backing or jute, as more fully developed hereinafter. Further, in the reverse reroll operation, the normally idling roller of reroll unit 5 should be driven for optimum operation, and particularly optimum creation of the initial loop or pocket and the first reroll forming wraps.

The unroll drive train includes a pair of couple gears 47 coupled to the shaft 43 by a chain 48 and to shaft 33 of the roller 19 of unroll cradle unit 12 by a chain 49, with a common idler shaft 50. The unroll drive train thus provides simultaneous and corresponding rotation of the cradle rollers 19 and 20 with the intermediate pressurized drive roller 8 in accordance with the selective engagement of the clutch unit 40. The several gear shafts 33, 43 and 50 are also fixedly connected by rigid members 50*a* and 50*b* such that the distances of each roller gear relative to shaft 50 is fixed, as shown in FIGS. 3 and 3*b*. The gears 47 and shaft 50 are movable as a unit and coupled to the linkage 30 of the orientation control lever 29. Pivoting of lever 29 thus repositions shaft 50 and through the coupling drive chain the position of the support of frame 21 to orient and square the roll 3 and carpet flap 4. The coupling chains and rigid connections define a toggle or collapsable type connection. Thus, shaft 50 is joined by members 50*a* and 50*b* to the respective clutch and roller gears to establish a fixed distance to each of said gears. When the shaft 50 is moved, the drive chain 48 pivots about shaft 43, while the chain 49 pivots about the gear of roller 19, which simultaneously moves along the rail to accommodate such pivotal movement.

The drive roller 8 is a relatively large diameter roller which is rotatably mounted in suitable bearings at the opposite ends at the front and back end wall structures 23 and 24 of the main frame 10. The driven end includes the driven shaft 43 projecting outwardly and coupled directly to an unroll clutch unit 40. The pressurized drive roller 8 is preferably provided with a plurality of longitudinally spaced friction drive belt members 51 secured to its outer face. The belt members 51 provide improved frictional engagement with the carpet flap 4.

In addition, the pressure roller 7 is mounted in a pivotally support and positioning linkage, shown most clearly in FIGS. 3 and 3*c*, to force the carpet 4 downwardly onto the drive roller 8 to create a firm clamping engagement of the carpet 4 which creates a positive holding action on the carpet storage roll 2. The combination thereby establishes an optimum feeding of the carpet over the cutting unit 9 and into the reroll cradle assembly 5.

The pressure roller 7 may be a simple steel roller, of a relatively small diameter, which is pivotally supported for positioning toward and away from drive roller 8. The roller 7 is rotatably mounted at the opposite ends in lever arms 52, interconnected by a support shaft 53. The shaft 53 is mounted in suitably bearings and projects forwardly through the drive enclosure. A control lever 54 is connected via an over center linkage 54*a* to the outer end of shaft 53 and is movable through approximately 90°, shown from a vertical position to a generally horizontal position, to move the pressure roller 7. In the horizontal, the pressure roller 7 is raised from the drive roller 8 to permit free movement of the carpet 4 over the roller 8. When the lever 54 is raised, the pressure roller 7 is pivoted downwardly and released to rest on the drive roller 8. The weight of the pressure roller 7 is such as to provide the desired locking engagement of the carpet 4 to the drive roller 8. If necessary, suitable resilient means, such as hydraulic, pneumatic or spring means, may of course be provided to positively force the pressure roller into engagement with the carpet.

The illustrated drive roller 8 is shown formed of two similar sections with an intermediate connecting shaft 55 which is rotatably supported in a suitable bearing unit 56. A carpet metering wheel 57 is rotatably mounted between the sections of driver roller 8 on the bearing unit 51. The face or periphery of the wheel 57 is bias upwardly and located slightly above the normal uppermost surface of the drive roller 8. The carpet flap 4 is forced into firm frictional engagement with the wheel 57 by the pressure roller 7. As the carpet 4 moves over the drive roller 8, it drives the measuring wheel 57 and provides a mechanical movement directly related to the linear movement of the carpet over the drive roller 8 and therefore cutting unit 9. The measuring wheel 57 in turn is coupled to a suitable signal generator 58. The output of the signal generator 58 drives the counter 15 for accurately recording the linear movement of the carpet past the drive roller 8. The generator 58 may be any suitable or known device such as a mechanical switch, a photoelectric or magnetic switch or the like for developing a series of pulse or digital signals directly related to the rotational movement of the wheel 57. Such an electrical digital signal is connected to any suitable pulse driven counter to record the length of carpet in accordance with conventional usuage for measurements. The counter is preferably a reversible counter 15 and includes the zero reset means 16. For example, a counter and drive is available from Encoder Products Company of Sand Point, Idaho, including preset counter series 803 and a pulse generator model 715.

The reset button 16 is shown on the control panel for setting of counter at zero. The counter 15 preferably includes an output signal at an output terminal means 60 when a presettable readout is created. The output terminal means is in turn connected to a stop control 61 to stop motor 36 and thereby the carpet movement. The feeding of the carpet 4 through the apparatus is thereby terminated with the end of the portion to be severed aligned with the cutting unit 9.

A particularly practical cutting assembly 9 includes guide rail 62 extending across and beneath the path of the carpet between the drive roll roller 8 and the reroll cradle unit 5. The guide rail 62 is fixedly mounted to the end wall structures 23 and 24 and includes a top slit or opening 63 through which a suitable sharp knife 64 is passed. The knife 64 is shown as a simple flat, plate-like member having an inclined cutting edge 65 extended across the plane of the carpet 4 and adapted to pass through the carpeting. The knife 64 is rigidly affixed to a drive chain 66, the opposite ends of which are rotatably sprocket mounted to the opposite end wall structures 23 and 24. A small drive motor 67 is coupled to the one chain sprocket 68 adjacent the rear end of the machine. The motor 67 is operable to move the chain 66 and interconnected knife 64 through the slot 63 in the cutting rail 62. The knife chain may be an endless chain for moving of the knife back to the start position beneath the cutting bar. A pair of equally spaced knife units may of course be provided to locate one in the start position during the cutting movement of the other. The small opening or slot 63 supports the knife 64 immediately adjacent to the carpet 4 and the inclined edge 65 permits the ready severing of any conventional carpeting. The upper end of the knife 64 may be provided with rigid strengthen bar 69. Spring guides 70 extend outwardly and downwardly into sliding engagement with the sides of the cutter rail 62 to continuously spread the carpet at the knife cutting edge 65, as most clearly shown in FIG. 5.

The operation of the cutting motor 67 is controlled from the control panel by the switch means 17. The system of course may be provided with an automatic cycle means responsive to the output of the counter but is preferably manually controlled to allow checking of the rerolled carpeting prior to cutting.

The reroll cradle unit 5 is mounted immediately rearwardly of the cutter rail 62. The reroll unit 5 includes a drive roller 72 and spaced movable support roller 73 with encircling support belts 74 defining a support for the rerolled carpet roll as the element is wound within unit 5. Drive roller 72 is rotatably mounted at the opposite ends in suitable bearing supports 75 on the end wall structures 23 and 24. The drive roller 72 is formed as a two part member having a center bearing support similar to the drive roller 8. The drive end of the roller 72 includes an outer shaft 76 which is coupled to the clutch unit 41 and is thus directly driven from the one output shaft of the motor-gear unit 37. The clutch unit 41 includes the similar on-off lever clutch for selective and separate coupling or engagement to the roller 72. The drive roller 72 of the reroll cradle unit 5 is preferably provided with a plurality of the longitudinal spaced friction drive belts 77 secured to its peripheral surface to propell the carpet into the final roll 6. The belts may be of a conventional conveyor traction belting type. Such material provides a satisfactory coupling to the carpeting while permitting any required relative movement without damage to the carpet backing. The support belts 74 are located intermediate the drive belts 77 and extend therefrom downwardly around an idle roller 78 and around the movable support roller 73. The idler roll 78 is located below the rollers and rotatably supported in the frame structure 10. The movable support roller 73 is a similar two-piece member having the surface friction elements or belts 79. Roller 73 is mounted at the center and opposite ends of the roller in a three-point pivot support. In particular, roller 73 is rotatably supported at the opposite ends and at the center in similar pivot arms 80 which are interconnected by a pivot shaft 81. The opposite ends of shaft 81 are pivotally mounted within frame 10. Hydraulic positioning cylinder units 82 are secured to the frame 10 adjacent the opposite end arms 80 and each include a cylinder 83 secured to the frame 10 and a piston rod 84 extended outwardly into a connection to a pivot attachment arm 85 depending from the end pivot arms 80. Extension of the rod 84 causes the pivot arms 85 and arms 80 to pivot inwardly thereby positioning of the pivoted roller 73 into close spacing to the driven roller 72. This creates a closed position, with the support belts 74 as a loop or tuck 85 located between the rollers 72 and 73 as shown in FIG. 2. Alternately, the piston-cylinder units 82 are actuated to retract the piston rods 84, resulting in the opposite pivotal movement of the pivot arms and the positioning of the roller 73 to the expanded position, with the belt members 74 generally straightened to form a shallow tuck or loop between the rollers 72 and 73, and thereby defining an enlarged opening and support for the reroll carpet roll.

The belts 74 may therefore be located in the tucked closed position which is employed to initiate the formation of the roll 6 of removed carpet, and expanded outwardly to a fully opened position where the belting is more or less tangential to the two rollers 73 and 74 with a slight tuck or sag, as at 85*a*, inwardly to support the continuously engaged reroll carpet roll.

The leading edge or flap 4 of carpet moves over the cutter bar unit 9 and into and between the two rollers 73 and 74 in the closed position. A conventional carpet core 86 may then be placed on the carpeting within the tuck or loop 85 and the drive unit again actuated. This results in the wrapping of a plurality of layers around the core 86 within the tucked belting. The roller 73 is then moved to the open position, at least partially, and the drives actuated to continue removal of the carpet from the main roll 3 and the rewinding thereof onto itself within the reroll unit 5. The opening of the movable roller 73 supports the enlarged rerolled carpet roll as it grows in size. When the desired carpeting has been removed and severed from roll 2, unit 5 is again driven to finish the wrapping of the carpet into a finished roll, which is appropriately tied to prevent unrolling. The rear cradle unit 5 can then be closed, forcing the completed roll from the apparatus.

A foot operated cable or bar 87 for the drive control may be provided extending on the complete length of the machine adjacent to the reroll cradle unit 5 to allow operator override and immediate stopping of the system operation in all phases of operation. The foot control member 87 may be used during the final processing of the roll, such as to permit convenient tieing or taping of the finished roll.

The operation of the illustrated embodiment of the invention is summarized, as follows.

The machine is positioned in the appropriate location and then the legs 11*a* are located into floor engagement to provide level and firm support of the apparatus. The pressure roller 7 is released by moving of the lever 54 to the horizontal position. The clutch levers 45 and 45' are in the disengaged position. The storage roll 3 is moved into position on the front cradle unit 2, such as by use of a conventional fork lift. The carpet roll 3 is positioned with the free end or flap 4 extending from the bottom thereof and located to move from the roll toward the pressure roller 8. If it is not, the flap can be readily appropriately positioned by actuating the front cradle drive unit 2. The flap 4 is manually positioned onto the power roller 8 with the pressure roller 7 raised. The carpet flap 4 is then driven by operation of the front cradle unit 2 and the drive roller 8 to advance the carpeting to the reroll cradle unit 5. The operator now checks the squared relationship of the carpet on the cutting bar unit 9 and therefore with respect to the rear cradle unit 5. If the carpeting is not squared, the cradle pivot control lever 29 is actuated to pivot the front cradle unit and accurately center the carpet the carpet flap 4 on the cutting bar unit 9. After appropriate squaring is established the pressure roller lever 54 is raised, thereby moving of the pressure roller 7 onto the top surface of the carpet 4 and forcing it into pressurized engagement with the drive roller 8 and with the metering wheel. The front cradle unit 2 is then actuated to reroll the carpet on to the storage roll 3 until the leading edge 88 is acurately located in the center of the cutting bar 62. This then places the carpeting in the zero or reference measuring position and the counter 15 is reset or zeroed by actuation of the reset button 16 to provide for an initial or reading zero reading. The front cradle unit 2, along with the coupled roller 8 and the reroll cradle unit 5, are then simultaneously actuated to advance the carpet generally to the center of the back pivoted roller 73 of the rear cradle unit 5. A winding core 86 is placed on the supporting belts 74 between the rollers 72 and 73. The rear cradle unit 5 is then closed, resulting in the core and the belt 74 moving downwardly into the loop 85 between the rollers, with the core and carpet 4 moving into the loop. This automatically creates a partial wrapping of the carpet onto the cardboard core 84. The front and rear cradle units 2 and 5 are then powered driven, at a relatively low speed, to establish an additional two or three wraps of the carpet onto the core. The drive apparatus is stopped or slowed through use of the control 18 and the lever 84*a* operated such that the rear cradle unit is opened, at least partially as shown in FIG. 2. This permits the carpet roll 6 to grow in size during the subsequent rerolling. The clutches 40 and 41 for both the front cradle unit 2 and the rear cradle unit 3 are engaged and establish the measured movement of the carpet from the storage roll 2 to the finished roll 6. The reroll unit 5 is driven at a slightly greater speed than unit 2 and roller 8 to pull on the carpet 4 and establish a taut length of carpet therebetween. During this movement, the carpet moves over the measuring wheel 57 driving the measuring wheel 57 and providing a count signals to the counter 15. When the desired amount of carpeting has been fed through the unit, the counter 15 automatically actuates the motor control to turn off the drive. This results in a practically instantaneous stoppage of the powered movement of the rollers which rapidly stop and stop the carpet with the terminal end of the carpet aligned with the cutting slot in the cutting unit 9. The knife motor 67 is then actuated and the knife 64 automatically moves through the slot 63 and severs the carpet 4 and then returns to its starting position and stops. The desired amount of carpeting has then been removed. The rear cradle unit 5 may then be actuated in a forward direction to wrap the final severed portion of the carpet onto the roll 6. The personnel can then move to the rear of the machine and move along the machine to effect tying of the unit along longitudinally spaced portions. The rear cradle unit 5 may then be closed, moving the pivoted roller 73 toward the fixed roller 72 with a resulting forcing of the roll 6 outwardly and from the cradle unit 5.

The front cradle unit 2 may be actuated to reverse its direction and reroll the flap 4 onto the carpet roll 3. The carpet roll 3 is then of course replaced in stock; unless of course, a further length of the carpet is to be removed.

As previously noted, both units 2 and 5 may be reversibly driven. If for any reason, the length of carpet to be removed is changed prior to the actual cutting, the units may be reversed to reverse the direction of carpet movement and reduce the amount of reroll carpeting. This will result in the rewinding of the carpeting from the reroll cradle unit 5 onto the storage roll 3 on the unroll cradle unit 2. Simultaneously, the measuring wheel 57 is reversely driven and reverses the counter reading to maintain presentation of the actual length of carpeting transferred past the cutter unit 9 and into the finished roll. If a substantial length of carpet must be rewound, release of the pressure roller may be required with loss accurate measurements. Alternatively clutch unit 41 may be released and the clutch 40 engaged to pull the carpet back to unit 2. The idling of unit 5 maintains the carpet 4 taut and the desired accurate reversing of the measuring wheel for appropriate reversal of the counter 15.

Although shown with the carpeting rewound on a core, the carpeting may be similarly wound upon itself without the central core. Thus, if the carpet flap 4 is allowed to move between the area into the loop or tuck 85, the carpet will automatically be directed into a continuous roll upon itself.

In short, the machine operator advances the carpet over the cutting bar, squares it, locks it in position, and presets the measuring device to the desired length to be cut. The system is then actuated to the automatic position and power supplied. The unit then automatically advances the carpet to be rerolled into the reroll cradle unit 5 where it is automatically rolled into a finished roll 6 with the terminal flap end terminating in precise overligning relationship to the cutter bar. The carpeting is removed and the finished roll 6 is completed while the storage roll is rewound for removal and replacement.

The apparatus thus allows the convenient manipulation of the roll using a single operator and without the necessity for any special highly technical knowledge or operating skill requirements.

Various modifications to the illustrated embodiment of the invention may of course be made within the concepts of the present invention. Thus, the particular method of driving the rollers can be varied to employ any other suitable drive means and permitting the independent control of the unrolled cradle unit and a reroll cradle unit. Further any other form of measuring system can of course be employed. The illustrated embodiment of the invention has, however, been found to provide an effective and reliable implementation of the concepts of the present invention.

Various modes in carrying out the invention are contemplated as being within the scope of the following claims, particularly pointing out and distinctly claiming the subject matter which is regarded as the invention.

We claim:

1. A reroll apparatus for selective reroll of a relatively wide elongated and flexible material from a storage roll of such material, comprising an unroll means adapted to rotatably support said storage roll with a generally horizontal rotational azis for unrolling of the free end of the material from said storage roll, a reroll means mounted in aligned parallel relationship to said axis of said storage roll as established by said unroll means and receiving the flap end of said material and engaging said material, said reroll means including a pair of roller means movable relative to each other to vary the spacing therebetween and a spacing guide means located below the roller means, belt means encircling said pair of roller means and said guide means and adapted to be located downwardly between said roller means to form a loop located below the roller means with the roller means in a closed position and stretching outwardly between said roller means as said means move outwardly of each other, said material being movable downwardly into said loop portion and rerolled upon itself to initiate a rerolling of said material in response to movement of said belt means, and means to selectively lock said roller means in fixed relation to each other.

2. The apparatus of claim 1 including a variable speed, constant torque direct current motor drive means coupled to said reroll means for selectively rotating said roller means.

3. The apparatus of claim 1 including a common prime mover having a constant torque output, first drive clutch means coupled to said primer mover and said unroll means to rotate the storage roll and second drive clutch means coupled to said prime mover and said reroll means, said clutch means each having a separate engagement control for separately and individually driving of the reroll means to provide for the selective transfer of the material from the storage roll to the reroll means, said drive means being reversible to allow selective transfer of the material between said unroll means and said reroll means.

4. The apparatus of claim 1 including a driving means mounted adjacent to the discharge side of the said unroll means, a pressure means movably mounted above and movable toward said driving means for selective frictional clamping of said material between said pressure means and said driving means for gripping of the material and establishing a positive controlled feed of the material from the storage roll and into the reroll means.

5. The reroll apparatus of claim 4 including a pivotal support for said unroll means for angularly orienting of said storage roll relative to said pressure means and said reroll means.

6. A rerolling apparatus for selectively reroll of a relatively wide elongated and flexible material element from a storage roll of such element, comprising an unroll cradle support means adapted to support said storage roll with a generally horizontal rotational axis, said support means including means for rotating of said storage roll to unwind a free flap end of the material from said storage roll, a reroll cradle support means including a pair of parallel roller means mounted in aligned parallel relationship to said axis of said storage roll as established by said unroll cradle support means, said reroll cradle support means including a first stationary rotatably driven roller adapted to receive the flap end of said material and frictionally engaging the undersurface of said material and including a second roller movably mounted adjacent said driven roller and selectively positioned in a first spaced position relatively closely spaced to said driven roller and in a second spaced position spaced outwardly of said first position, means holding said movable roller in said first and second positions during movement of the material from the storage roll into said reroll unit, flexible endless support means encircling said pair of rollers to define an upper support run and a lower return run and adapted to be located downwardly between said rollers in the form of a loop with the movable roller in the closed position and moving outwardly with the rollers and between said rollers with said movable rollers in said second position, and a guide member located below said rollers and holding said flexible endless support means in spaced relation to said pair of rollers, said flexible endless support means being of a length whereby said loop extends below the pair of rollers to form an initial rolling of the material.

7. The apparatus of claim 6 including a clamping driven means located between the unroll cradle unit and the reroll cradle unit and coupled to operate with the unroll cradle unit to positively hold the carpet moving from the storage roll into the reroll means.

8. The apparatus of claim 6 or 7 wherein said drive means for said unroll means, said reroll means and said driven means are reversible to allow selective transfer of the material to and from said unroll cradle unit and said reroll cradle unit.

9. The apparatus of claim 7 including a cutting means between the clamping driven means and the reroll means, and measuring means having a driven input means coupled to the element moving from said clamping driven means into said reroll means for monitoring the length of element moved past the input means in reference to said cutting means.

10. The apparatus of claim 6 including a cutting means located between, said first and second named cradle units, said cutting means including a cutting guide means knife means including a knife member projected outwardly of said guide means past the plane of the material on the top wall of guide means, and drive means coupled to said knife member for selectively moving said knife through said guide means, and means coupled to the knife member and moving with the knife member to spread the carpeting at the knife member.

11. The apparatus of claim 10 wherein said guide means includes a cutting bar unit having a longitudinal extending slot, said knife member projects outwardly through said slot, said knife drive means includes an endless reversible chain means coupled to said knife member and a reversible chain drive means coupled to said chain means for selectively moving said knife through said slot for severing the flexible element above said slot, said separation means includes a member extending downwardly and rearwardly from the upper portion of the knife member to the one side of said bar unit.

12. The apparatus of claim 6 including a drive roller mounted adjacent to the discharge side of the said unroll cradle support means, a pressure roller movably mounted above and movable toward said drive roller for selective frictional clamping of said material between said pressure roller and said drive roller for gripping of the material and establishing a positive feed of the material from the storage roll and into the reroll cradle means, said driven roller of said reroll cradle support means establishing a pulling force on said element from said pressure roller to hold the element taut therebetween.

13. The apparatus of claim 12 wherein a linear measuring wheel means is rotatably mounted generally centrally of said drive roller, said measuring wheel being coupled to the element as the element passes over the drive roller and establishing a signal corresponding to the length of the material passing over said drive roller, and output means connected to receive said signal and operable to record said length of said material.

14. The apparatus of claim 13 wherein an interlocking means is connected to said control means and is operable to automatically terminate operation of the drive means in response to movement of said preselected quantity of said material over said drive roller.

15. A carpet roll handling apparatus for selective removal of sections of carpet wound on a storage roll, and having an outer end carpet flap comprising an unroll cradle unit having a pair of horizontally spaced support rollers and a plurality of supporting endless belts looped about said spaced rollers and longitudinally spaced along the length of the rollers and adapted to support said storage roll with a generally horizontal axis of rotation, support means for said rollers including a pivot support having a vertical pivot axis to allow limited angular orientation of said carpet in a horizontal plane, a drive roller rotatably mounted substantially parallel to said support rollers and adapted to have the carpet flap pass thereover, a pressure roller movably mounted above said drive roller and adapted to move downwardly toward the drive roller, said pressure roller being adapted to rest on the opposed face of the carpet and to clamp the carpet into frictional driven engagement with said drive roller, said pressure roller being formed of a sufficient weight to establish a gravity force on the carpeting to establish a positive driving of the carpet, drive means for rotating of said support rollers and said drive roller to provide for feeding of the carpet therefrom and into said drive roller and said pressure roller for transport, a cutting bar means located in parallel relation to said drive roller with an upper wall located to support the carpet moving from the drive roller, said cutting bar unit including a guide bar having a longitudinal extending slot, a chain driven knife means located within aid bar and including a knife member projected outwardly through the slot passed the plane of the material on the top wall of the bar, a chain means coupled to said knife, and a motor drive means coupled to said chain means for selectively moving said knife through said slot, a reroll cradle units including a first stationary rotatably driven roller adapted to receive the flap end of said material from said cutting bar means and frictionally engaging the undersurface of said material and including a second pivotal roller pivotally mounted adjacent the said driven roller and selectively positioned in a first position relatively closely spaced to said driven roller and adapted to be pivoted outwardly in spaced relation thereto, a control means connected to pivot mounted roller and operable to selectively locate and lock said roller in a closed position and in an open position, said driving and pivotal roller being mounted parallel to each other and to said cutting bar means, belt means encircling said rollers of said unroll cradle unit and adapted to be located downwardly between said rollers and below said rollers with the pivotal roller in the closed position and stretching outwardly between said rollers as said pivotal roller moves outwardly, reroll drive means coupled to rotate the drivin roller of the reroll cradle unit at a rotational speed in excess of said drive roller to pull the carpet across the cutting bar menas, a reversible motor means including a gear bar establishing first and second output shaft means, releasable clutch means coupling the first output shaft means to the unroll drive means, second releasable clutch means coupling the second output shaft means to the reroll drive means, and measuring means located to sense the movement of the material from said storage roll over said cutting bar for monitoring the material withdrawn spaced storage roll and operable to stop said reversible motor means.

16. A carpet roll handling apparatus for selective removal of sections of carpet wound on a stoarge roll, and having an outer end carpet flap comprising an unroll cradle unit adapted to support said storage roll with a generally horizontal axis of rotation, support means for said unroll cradle unit including a pivot support having a vertical pivot axis to allow limited angular orientation of said carpet in a horizontal plane, a drive roller rotatably mounted substantially parallel to said support rollers and adapted to have the carpet flap pass thereover, a pressure roller movably mounted above said drive roller and adapted to move downwardly toward the drive roller, said pressure roller being adapted to rest on the opposed face of the carpet and to clamp the carpet into frictional driven engagement with said drive roller and forcing said carpeting into positive driving engagement with the drive roller, a cutting bar means located to the discharge side of the drive roller and in parallel relation to said drive roller with an upper wall located to support the carpet moving from the drive roller, said cutting bar unit including a cutting means selectively moving across said upper wall to severe the carpeting, and a reroll cradle unit adapted to receive the flap end of said material from said cutting bar means and frictionally engaging the undersurface of said material and operable to reroll the carpeting from the cutting bar means, and a drive means connected to operate the reroll means to move the material from said pressure roller over said cutting bar and holding the material in a taut condition.

17. The apparatus of claim 16 including a constant torque direct current motor means having a constant torque output and connected to drive said reroll means, first clutch means coupling said motor means to said reroll means, and drive control means for controlling the speed of said roller means.

18. The apparatus of claim 17 wherein a second clutch means couples said motor means to said unroll means, said first and second clutch means including separate engaging controls to provide selective connection of the motor means to the unroll means and to the reroll means.

* * * * *

UNITED STATES PATENT AND TRADEMARK OFFICE

CERTIFICATE OF CORRECTION

PATENT NO. : 4,273,300

DATED : June 16, 1981

INVENTOR(S) : Walter Wojtowicz and Gust Mursau

It is certified that error appears in the above-identified patent and that said Letters Patent are hereby corrected as shown below:

| | | |
|---|---|---|
| Column 15, | Line 35, | Cancel "drivin" and substitute therefor ---driving--- |
| Column 16, | Line 4, | Cancel "stoarge" and substitute therefor ---storage--- |
| Column 16, | Line 25, | Cancel "severe" and substitute therefor ---sever--- |

Signed and Sealed this

*Twenty-seventh* Day of *October 1981*

[SEAL]

*Attest:*

GERALD J. MOSSINGHOFF

*Attesting Officer*

*Commissioner of Patents and Trademarks*